US009692121B2

(12) United States Patent
Grabert

(10) Patent No.: US 9,692,121 B2
(45) Date of Patent: Jun. 27, 2017

(54) DIRECTIONAL-ANTENNA-PLACEMENT VISUAL AID AND METHOD

(71) Applicant: Christopher Grabert, Raceland, LA (US)

(72) Inventor: Christopher Grabert, Raceland, LA (US)

( * ) Notice: Subject to any disclaimer, the term of this patent is extended or adjusted under 35 U.S.C. 154(b) by 95 days.

(21) Appl. No.: 14/749,748

(22) Filed: Jun. 25, 2015

(65) Prior Publication Data

US 2016/0380347 A1 Dec. 29, 2016

(51) Int. Cl.
*H01Q 3/00* (2006.01)
*H01Q 3/04* (2006.01)

(52) U.S. Cl.
CPC ..... *H01Q 3/00* (2013.01); *H01Q 3/04* (2013.01)

(58) Field of Classification Search
CPC ..... H01Q 3/00; H01Q 3/04
USPC ..... 33/228, 645, DIG. 21
See application file for complete search history.

(56) References Cited

U.S. PATENT DOCUMENTS 4,319,406 A * 3/1982 Pehrson, Sr. ..... G01B 5/25 33/286
5,162,811 A 11/1992 Lammers et al.
5,461,793 A * 10/1995 Melville ..... G01B 11/27 33/286
6,347,457 B1 * 2/2002 Espinoza ..... G01B 5/0025 33/286
6,473,980 B2 * 11/2002 Ripingill, Jr. ..... F41J 5/02 33/275 R
6,594,910 B2 7/2003 Wishart
6,628,378 B1 * 9/2003 Marangoni ..... G01B 11/27 33/286
6,889,441 B2 * 5/2005 Seiffert ..... G01B 11/27 33/286
7,073,268 B1 * 7/2006 Etter ..... B23D 59/002 33/286
7,091,922 B2 8/2006 Parsons et al.
7,155,834 B2 * 1/2007 Palumbo, III ..... G01C 15/002 33/227
7,171,759 B1 * 2/2007 Loen ..... G01B 5/25 33/1 N
7,669,339 B1 3/2010 Arnal et al.
7,748,127 B1 * 7/2010 Cosimano ..... G01C 15/002 33/286
8,004,664 B2 * 8/2011 Etter ..... B23B 25/06 356/139.01
8,630,828 B2 1/2014 Parker
2004/0239917 A1 * 12/2004 Loen ..... G01C 1/00 356/141.2
2005/0052640 A1 * 3/2005 Loen ..... G01B 11/272 356/152.1
2008/0297425 A1 12/2008 Axton et al.
2012/0176608 A1 7/2012 McCown
(Continued)

FOREIGN PATENT DOCUMENTS

CN 103163564 6/2013

*Primary Examiner* — Yaritza Guadalupe-McCall
(74) *Attorney, Agent, or Firm* — Keaty Law Firm LLC

(57) ABSTRACT

A directional-antenna-placement visual aid and method of placing directional antenna, especially useful for minimization of overlapping cellular-telephone signals in large venues, providing a projected-light representation of the coverage of an antenna during the mounting or adjustment of the antenna.

9 Claims, 6 Drawing Sheets

(56) References Cited

U.S. PATENT DOCUMENTS

2016/0380347 A1* 12/2016 Grabert ..... H01Q 3/04
33/228

* cited by examiner

FIG. 1
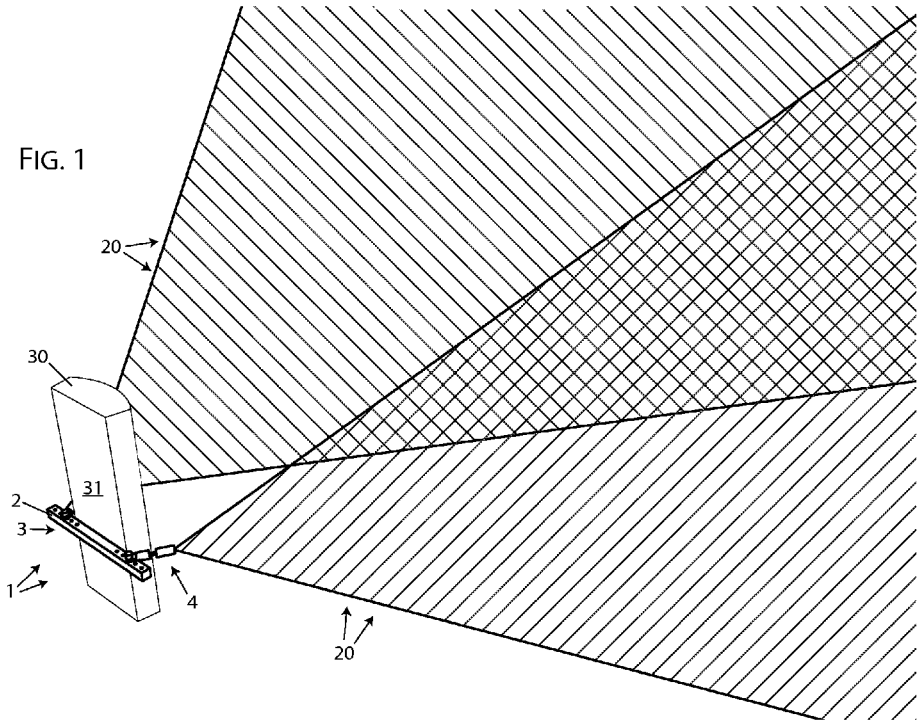
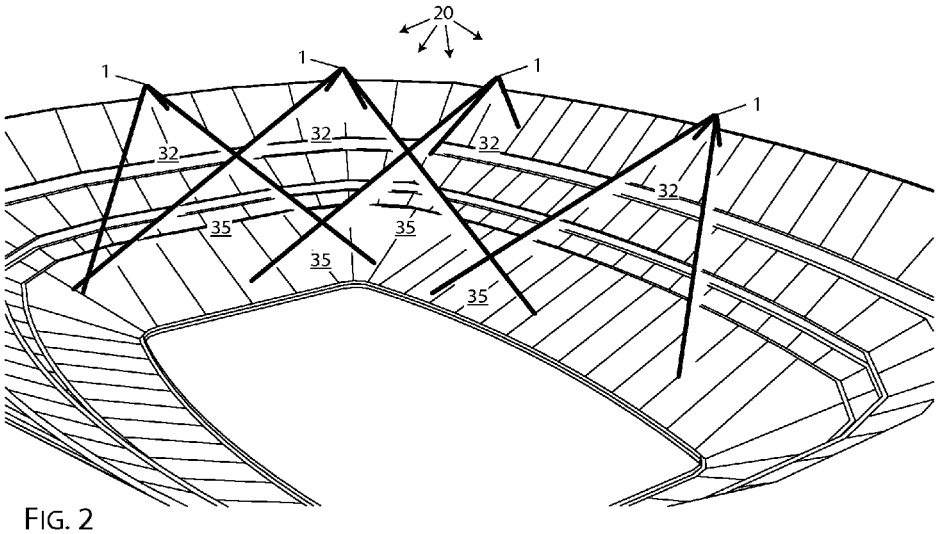
FIG. 2

DIRECTIONAL-ANTENNA-PLACEMENT VISUAL AID AND METHOD

BACKGROUND OF THE INVENTION

This invention provides a directional-antenna-placement visual aid and method of placing directional antenna.

Radio frequency (RF) electromagnetic signals are used for real-time two-way communication. A signal in a chosen frequency band can be modulated to produce an analog or a digital signal. Portions of a signal can be spread across more than one frequency band. Signals can be combined and transmitted on the same frequency band or bands essentially simultaneously, and each of a large number of various receivers can isolate the signal of interest from the combined signal. The ability to combine and separate several individual signals on the same frequency band is the basis for cellular telephone service and for similar communications methods such as private or governmental communications systems.

In contrast to powerful single-point radio-frequency (RF) transmitters and receivers, cellular telephone service employs a large number of widely distributed base-station antennae serving relatively small cells at relatively low power. These are commonly seen in the form of cellular telephone towers or can be mounted on, or in, buildings. In theory, any given frequency band may be safely re-used for any antenna at a sufficient distance from, or otherwise isolated from, another antenna using that frequency band.

Although omnidirectional antennae can be used for cellular telephone base stations, the common practice is to use directional antennae having defined angles of coverage in order to better allocate and control the spatial distribution of the RF signals.

The cellular telephone networks possess a relatively small number of radio-frequency bands, or channels, to serve a relatively immense number of users of mobile cellular telephones. Each cellular telephone performs background communications with the cellular network, so that the network knows that a given cellular telephone is in communication with a specific base-station or tower, and the cellular network does not waste bandwidth or channels sending that user's signals through base stations that are physically remote from that cellular telephone's reported location. In order to accommodate more channels, and therefore more users, in physical areas densely populated with users, the normal-sized cell is subdivided into smaller cells, such as picocells and femtocells. The subdivisions allow frequency bands or channels to be re-used within a closer proximity to each other.

If the number of active cellular telephones in a given area exceeds the number of available channels of bandwidth in that area, many of the cellular telephones will experience difficulty with placing, receiving, and continuing calls without dropping. For this reason, many large venues for large gatherings of people, such as business meetings and expositions, sports, and entertainment, are equipped with a large number of antennae creating multiple subdivided cells within the venue.

Cellular telephones can detect signals from more than one base station or tower, especially within smaller, subdivided cells. Generally, one base station will have a significantly stronger signal, and the cellular telephone will be able to recognize and filter out the competing weaker signals, isolating the stronger signal. But in some circumstances a cellular telephone will not be able to isolate just one signal, and will present more than one signal to the user's cellular telephone, as cross talk, noise, or dropped calls.

The strength of radio frequencies received by any given cellular telephone in any given place varies greatly because of a number of factors, from large, such as whether the cellular telephone is on a hilltop or on one side or another of the hill, to small, such as how much of a user's hand covers the antenna portion of the handset. When a cellular telephone is receiving similar-strength signals from more than one base station or tower, the relative strengths of those signals is likely to vary, with the positions of weaker and stronger signals changing back and forth.

In order to accommodate the movement of cellular telephones from one base station or tower, to another, even during the progress of a telephone call, a method of soft handover or handoff is employed by the cellular networks. In normal circumstances such as driving down the highway, the cellular telephone will be mapped to a specific base station at any given point in time, and will eventually leave that base station behind. As the signal from the next, forward tower becomes stronger, the cellular network will reserve a channel on that forward tower for the approaching cellular telephone. At some point between the two towers, the next tower will become the primary tower. But the behind tower does not release the channel immediately, because of the possibilities that the apparent strength of the signal from the forward tower was only a temporary condition, and the transfer to the forward tower fails, in which case the behind tower will continue to be or resume being the primary tower for service to that user.

The soft handover method, where an additional channel on a weaker-signal tower is reserved for a user in anticipation of the user moving toward that tower, and where the channel is maintained on the formerly stronger-signal tower even after it becomes the weaker-signal tower, means that one cellular telephone will tie up more than one channel of the cellular network's bandwidth during the time the cellular telephone remains in a position between two or more towers. In circumstances where, for example, a user is approaching an area between two or more different forward towers, it is possible that the user will tie up even more than two channels of bandwidth during the transition.

Under the circumstances of a cellular telephone traveling in a vehicle, the periods of transition are relatively brief, and the additional bandwidth burden on the cellular network is seen as a reasonable trade-off for the avoidance of dropped calls.

In a large venue equipped for cellular telephone coverage, however, the cellular telephones are much less mobile, and may not move at all, for a user sitting watching a sports or entertainment event, or may move at a walking pace with frequent stops for a business exhibition. If any given cellular telephone comes to rest in, or travels slowly through, an area covered by signals from more than one antenna from the relevant cellular network, then that one cellular telephone will linger in the soft-handover condition, tying up two or more channels of bandwidth, for a long time. When the user shifts position or moves the cellular telephone, the shifting of the relative signal strengths may trigger a fresh soft handover.

For the cellular networks, the large-venue issue of a large number of cellular telephones each tying up two or more channels of bandwidth for very long periods is an issue of expense and of quality of service. The number of available channels is finite and relatively small. The soft-handover protocol is already established and is programmed into all handsets and switching equipment. Further subdivision of cells into even smaller cells is limited by available bandwidth and by the undesirable consequence that even more cells would mean even more overlapping signals and more soft handovers.

The installation of large numbers of cellular-telephone RF antennae in large venues, with the intent of providing as much coverage as possible, can have the unfortunate effect of creating areas of overlapping signals of nearly equivalent strength, putting a great many stationary cellular telephones into a soft-handover condition, with each cellular telephone tying up at least two channels for the entirety of the time. The effects of overlapping signals are not just a misallocation of a cellular network's bandwidth. The overlapping signals lead to a degradation of the quality of service affecting cellular telephone users in several ways. Besides the tying up of channels, which leads to dropped calls and low quality of service, the extraneous RF signals can have phase-cancelling effects on the desired signal at the cellular telephone, and can produce crosstalk and noise at the cellular telephone.

Although the individual antenna elements for cellular telephone RF are only inches long, the standard directional antenna array is approximately one meter or three feet in the longest dimension, nominally the vertical dimension, one-third of that in width, and one-sixth of that in depth. The sending-and-receiving or coverage angle of a standard cellular telephone RF directional antenna is likely to be in the range of 60 to 70 degrees in the longest, nominally vertical dimension, and 20 to 30 degrees in the perpendicular dimension. Antenna arrays generally have flat backs, which reduce their profile, and receptacles for power and signal connections and for a variety of mounts for physical mounting to towers and to outside and inside walls of buildings.

Directional antennae have known angles of coverage and are capable of being aimed. Although they are usually seen mounted with the longest dimension and coverage vertical, they can also be mounted with the longest dimension and coverage horizontal.

But RF signals are invisible, making precise aiming difficult. The present state of the art in large venues is to mount the antennae, then to have a technician walk every row and aisle of the venue with a test device that records the signal strengths at each individual position, and then to upload all of that data into a computer to produce an analysis that can identify areas of too little or too much coverage. From that analysis, antennae can be re-mounted or re-positioned for another try, and then the process of walking the venue and analyzing the data must be performed again.

SUMMARY OF THE INVENTION

The present invention provides a directional-antenna-placement visual aid and method of placing directional antenna, especially useful for minimization of overlapping cellular-telephone signals in large venues, providing a projected-light representation of the coverage of an antenna during the mounting or adjustment of the antenna.

BRIEF DESCRIPTION OF THE DRAWINGS

Reference will now be made to the drawings, wherein like parts are designated by like numerals, and wherein FIG. 1 is a schematic perspective view of the invention mounted on a standard directional antenna.

FIG. 2 is a schematic perspective view of the invention in use in a large venue.

DETAILED DESCRIPTION OF THE INVENTION

Referring to FIG. 1 and FIG. 2, my invention provides a directional-antenna-placement visual aid 1 and method of placing directional antennae by providing a projected-light representation of the coverage of an antenna during the mounting or adjustment of the antenna.

In a large venue having several directional antennae, my directional-antenna-placement visual aid 1 can be used to visually identify the boundaries of the invisible directional signal patterns 32 of antennae and therefore areas of the venue that are covered by more than one directional signal from more than one antenna.

The standard directional antenna 30 has an antenna-mounting surface 31 that has a known angular relationship to the directional-signal pattern of the antenna. Generally this antenna-mounting surface is the back of the unit, and is perpendicular to the directional signal.

Figure 3:
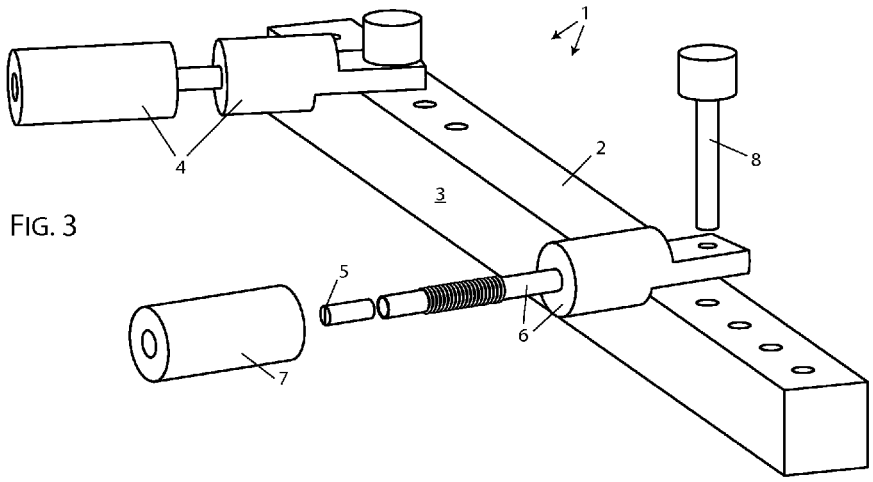
FIG. 3 is a partially exploded perspective view of the invention.
Figure 4:
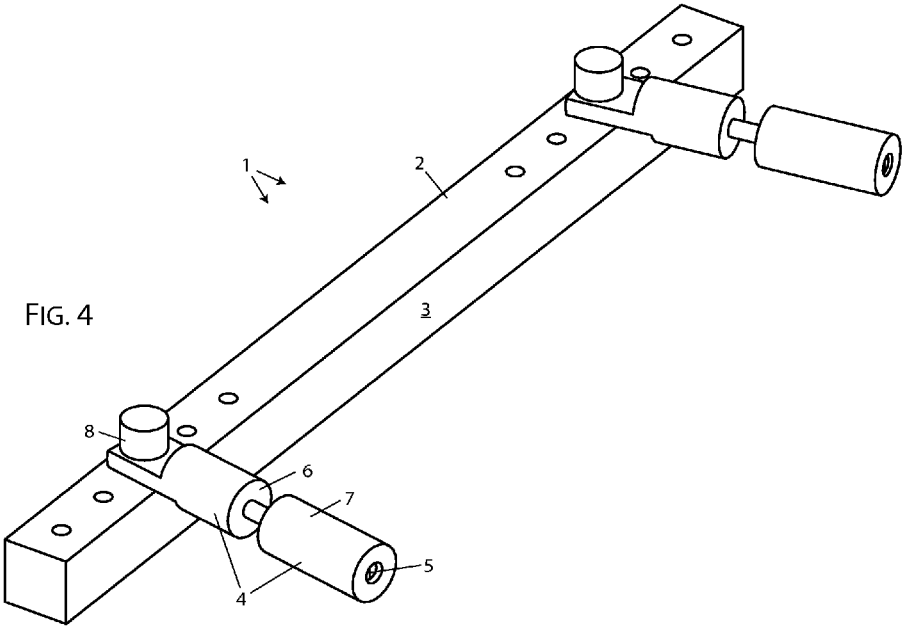
FIG. 4 is a perspective view of the invention.

Referring to FIG. 3 and FIG. 4, my invention provides a positioning bar 2 having an antenna-matching surface 3, for the purpose of placing the visual aid in the same orientation as the directional antenna. Generally, the antenna-matching surface 3 will be flat, and will be placed against a portion of the flat back of the directional antenna. This placement is temporary, for the time it takes to adjust the antenna, and may be held in place by hand or by a standard clamp.

Attached to the positioning bar 2 is at least one laser-light projector 4, projecting at least two lines of laser light 20, which is of the nature of the laser light produced by laser pointers, bar-code scanners, laser levels and measuring devices, and the like. Such laser light is regarded as safe when adequate precautions are taken. Laser-light sources, including optical lenses and power supplies, are available as standard components.

In a preferred embodiment of my invention, there are two laser-light projectors 4, each producing a line of laser light, and each being adjustable for the angle of projection and the length of the projected line of laser light. It is possible to devise a single laser-light projector capable of projecting the at least two lines of laser light at the proper angle and length. And it is possible to utilize more than two laser-light projectors and to project more than two lines of laser light.

Figure 5:
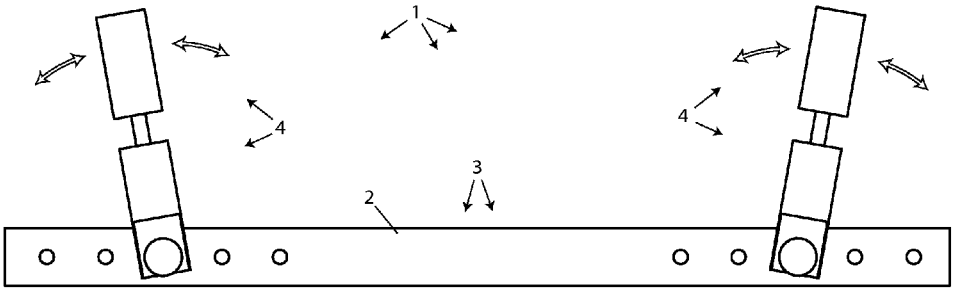
FIG. 5 is a top view of the invention.
Figure 6:
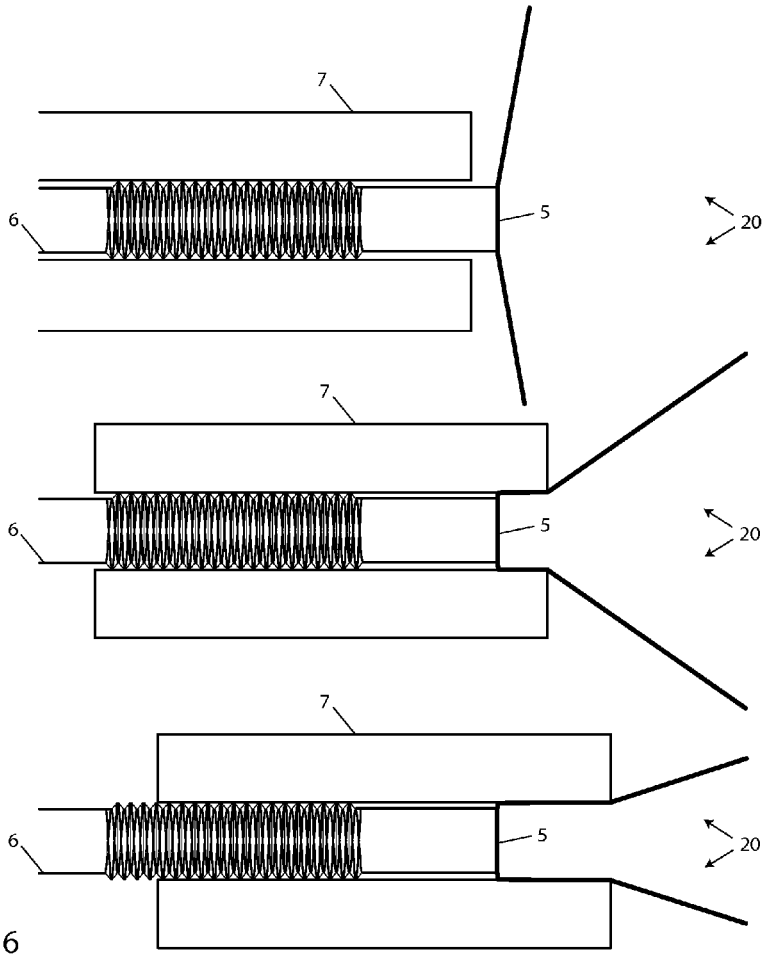
FIG. 6 is a cutaway schematic view of the influence of placement of the outer sleeve in relation to the laser emitter of the invention.

In a preferred embodiment, the laser-light projector 4 has a laser-light emitter 5 fitted into one end of an inner sleeve 6 that is rotatably attached at the opposite end to the positioning bar 2 by a rotatable connector 8 so that the azimuth of the projected laser light in relation to the antenna-matching surface can be fixed to correspond to the nominally horizontal coverage angle of the directional antenna, as shown in FIG. 5. After the azimuth is set, the inner sleeve 6 can be fixed in place using a tightenable rotatable connector 8. An outer sleeve 7 is placed around the inner sleeve 6 to symmetrically block whatever length of the projected line is not needed, as shown in FIG. 6. Placing the outer sleeve 7 to extend further from the laser-light emitter 5 at the end of the inner sleeve 6 will block more laser light and will make the projected line shorter, while placing the outer sleeve 7 closer to the laser-light emitter 5 at the end of the inner sleeve 6 will make the projected line longer. The inner and outer sleeves can be correspondingly threaded to provide a controlled means of placement. A standard tightenable connector can be used to fix the outer sleeve to the inner sleeve. The center of each projected nominally vertical line is always perpendicular to the antenna-matching surface. Therefore, the endpoints of the nominally vertical lines define upper and lower horizontal lines as well, and the endpoints of the vertical lines can be fixed to correspond to the nominally vertical coverage angle of the directional antenna. Optionally, additional laser-light sources or additional optics can be employed to project additional lines.

In a preferred embodiment, two laser-light lines 20 are projected, usually vertically, with their azimuths controlled by fixing the angle of the laser-light projector relative to the positioning bar and therefore relative to the antenna-mounting surface having a known angular relationship to the directional-signal pattern, by tightening a standard tightenable connector between each laser-light projector and the positioning bar.

Where the laser-light lines are fixed at the proper angle and length corresponding to the directional signal coverage of the directional antenna, the resulting vertical lines 20 will be projected at the same angle as the vertical outer bounds of the directional signal. The endpoints of the vertical lines will define the upper and lower horizontal outer bounds of the directional signal. The result is a projected rectangle that increases and spreads in size with greater distance in the same way, at the same rate, that the outer bounds of the directional RF signal increases and spreads with greater distance. Because the RF signals used for cellular telephones travel in straight lines, like light does, the projected lines of light accurately track the outer bounds of the RF directional signal.

In use, the directional-antenna-placement visual aid 1 is set up with the proper angle of projection of the laser-light lines adjusted, corresponding to the angle of nominally horizontal coverage of the directional antenna. The length of the projected laser-light lines is adjusted, corresponding to the angle of nominally vertical coverage of the directional antenna. This adjustment of the angle and length of the projected laser-light lines can be done using calibrated markings on the visual aid, or may be done by projecting laser-light lines upon a planar surface of known dimensions.

The adjusted visual aid 1 is then temporarily mounted upon a standard directional antenna 30, with the antenna-matching surface 3 in contact with or otherwise in a parallel plane with the antenna-mounting surface 31 that has a known angular relationship to the directional-signal pattern of the antenna.

Figure 7:
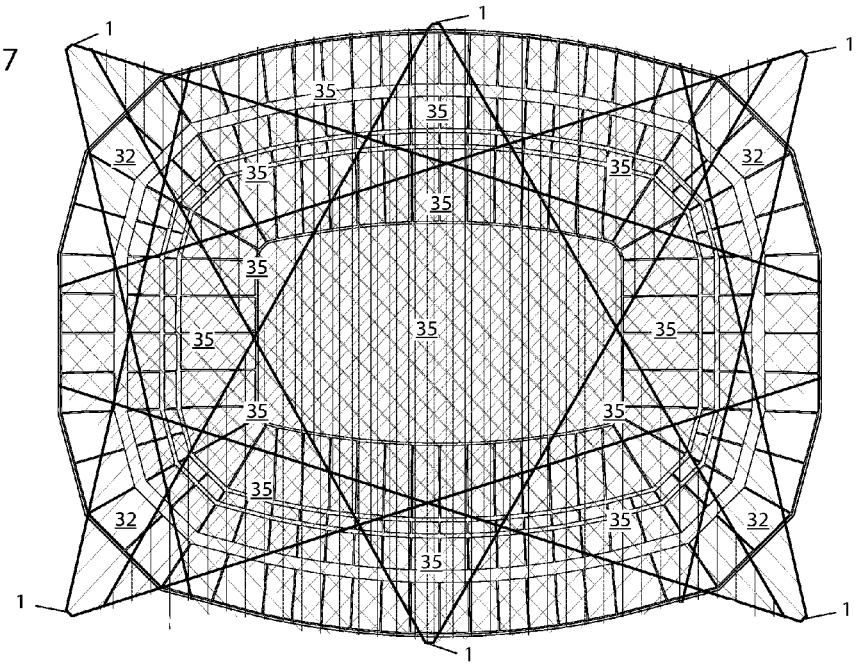
FIG. 7 is a schematic view of the invention in use in a large venue having many areas of overlapping RF signals.

When the projected laser-light lines corresponding to the boundary of the directional-signal pattern of the antenna are matched to a surface of the antenna having a known angular relationship to the directional-signal pattern of the antenna, the projected laser-light lines provide a visual indication of the coverage of the invisible RF signal pattern of the antenna. Referring to FIG. 7, in a large venue with multiple antennae, this ability to see the signal pattern 32 of each individual directional antenna aids in placement and adjustment of each antenna so that areas of the venue covered by more than one signal pattern 35 can be minimized or eliminated.

Figure 8:
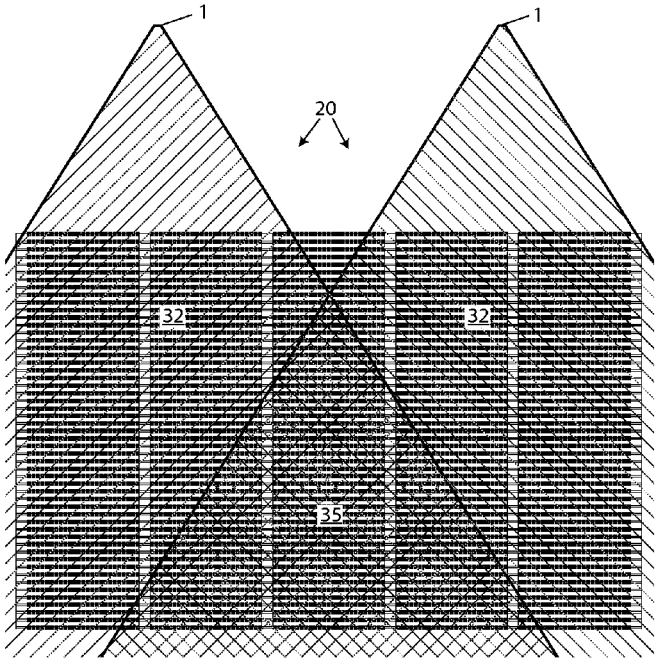
FIG. 8 is a schematic view of the invention in use in a portion of a large venue, having 2 directional antennae with poor placement.

Referring to FIG. 8, my directional-antenna-placement visual aid 1 reveals the approximately 60 degree angles of horizontal coverage of 2 antennae placed behind and in parallel with 5 sections of 56 rows of 25 seats, totaling 7,000 seats, and the resulting areas having coverage from just one antenna 32, from more than one antenna 35, or no coverage at all. Cellular telephones in the approximately 100 seats with no coverage at all will not work, which is an undesirable circumstance. Cellular telephones in the approximately 2000 seats with coverage from more than one antenna 35 will almost certainly stay in a soft-handover condition during the entire time that the seats are occupied, with each cellular telephone tying up more than one channel of bandwidth for that entire time.

Figure 9:
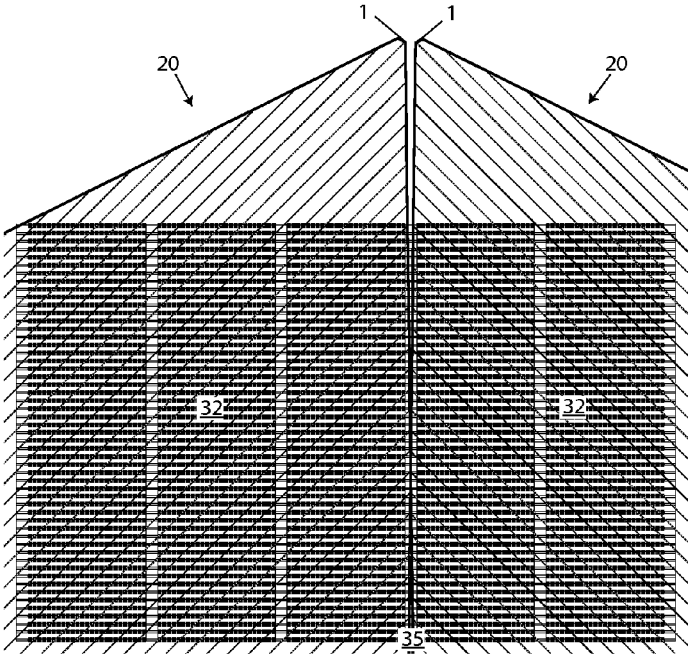
FIG. 9 is a schematic view of the invention in use in a portion of large venue, having 2 directional antennae with good placement.

Referring to FIG. 9, my directional-antenna-placement visual aid 1 reveals the approximately 60 degree angles of horizontal coverage of 2 antennae placed together, behind, and at angles with 5 sections of 56 rows of 25 seats, totaling 7,000 seats, and the resulting areas having coverage from just one antenna 32 or from more than one antenna 35. The number of seats having coverage from more than one antenna 35 is very small, and very few cellular telephones will stay in a soft-handover condition and tie up more than one channel of bandwidth.

Figure 10:
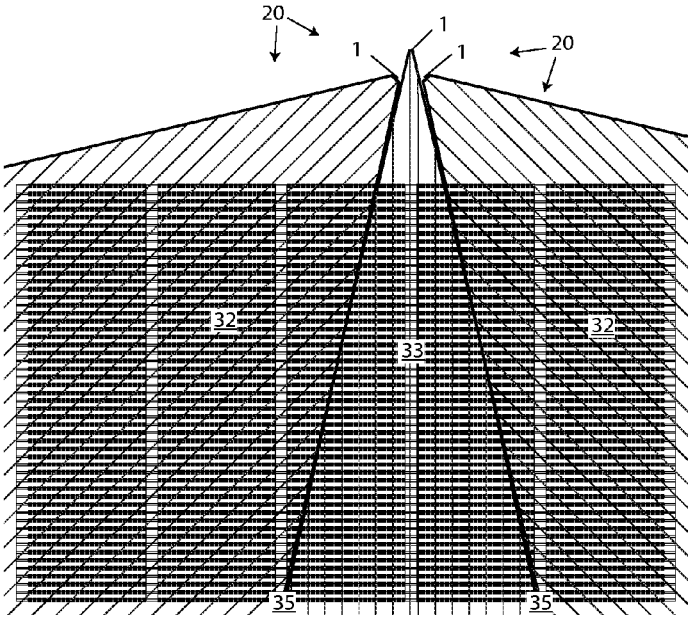
FIG. 10 is a schematic view of the invention in use in a portion of a large venue, having 3 directional antennae with good placement.

Referring to FIG. 10, my directional-antenna-placement visual aid 1 reveals the approximately 60 degree angles of horizontal coverage of 2 antennae, and the approximately 30 degree angle of horizontal coverage of 1 antenna, placed together, behind, and at angles with 5 sections of 56 rows of 25 seats, totaling 7,000 seats, and the resulting areas having coverage from just one 60-degree antenna 32, from just one 30-degree antenna 33, or from more than one antenna 35. The number of seats having coverage from more than one antenna 35 is very small, and very few cellular telephones will stay in a soft-handover condition and tie up more than one channel of bandwidth.

Figure 11:
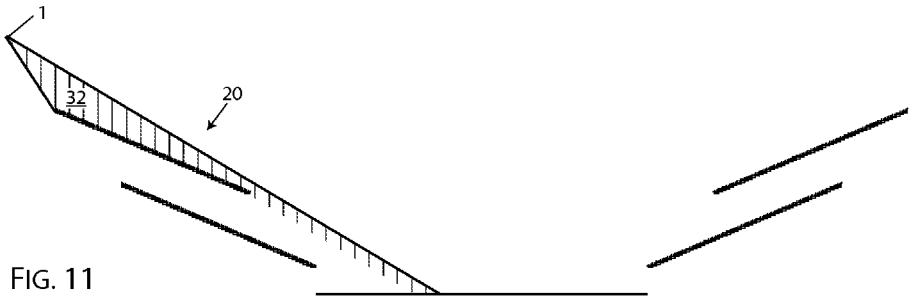
FIG. 11 is a schematic cross-sectional view of the invention in use in a large venue, having a directional antenna placed so as to produce a confined coverage.
Figure 12:
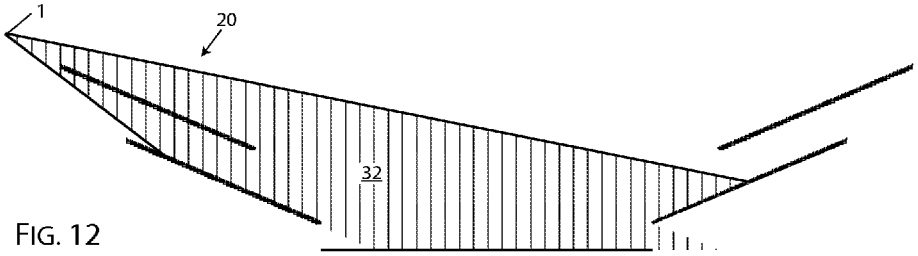
FIG. 12 is a schematic cross-sectional view of the invention in use in a large venue, having a directional antenna placed so as to produce a broad coverage.
Figure 13:
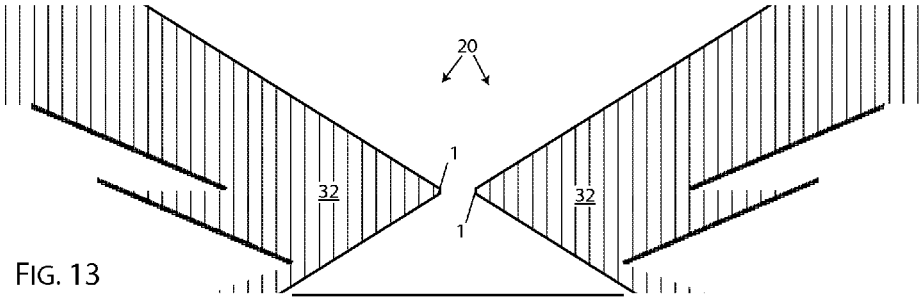
FIG. 13 is a schematic cross-sectional view of the invention in use in a large venue, having 2 directional antennae placed in opposite directions.

Referring to FIG. 11, FIG. 12, and FIG. 13, my directional-antenna-placement visual aid 1 reveals the consequences of placement and vertical angles of directional antennae in a venue having different, overlapping, facing levels of seating made of an RF-blocking material such as reinforced concrete.

FIG. 11 shows an area of coverage 32 from a directional antenna placed high and behind an upper terrace of seating, and angled sharply downward. Such a placement covers only the upper terrace of seating, because the building material blocks reception by the level below, and because the downward angle prevents the signal from reaching the opposite, facing seating.

FIG. 12 shows an area of coverage 32 from a directional antenna placed lower and behind an upper terrace of seating, and angled less sharply downward. Such a placement causes RF signal to reach not only the upper terrace of seating, but also much of seating immediately below, the central area, and some of the opposite, facing seating. If those additional areas of seating are covered by other antennae, then cellular telephones in those additional areas of seating are likely to stay in a soft-handover condition and tie up more than one channel of bandwidth.

FIG. 13 shows areas of coverage 32 from 2 directional antennae placed high and centrally in a venue, back to back and level vertically. Such a placement gives good coverage with no spillover, but fails to cover some areas of seating because the building material blocks reception.

By using my directional-antenna-placement visual aid 1 to be able to see the boundaries of each directional antenna's invisible RF signal coverage, each antenna can be precisely placed and adjusted to provide complete coverage for all of the seats in a large venue, while avoiding or minimizing areas having coverage from more than one antenna, where cellular telephones will almost certainly stay in a soft-handover condition during the entire time that the seats are occupied, with each cellular telephone tying up more than one channel of bandwidth for that entire time.

Many changes and modifications can be made in the present invention without departing from the spirit thereof. I therefore pray that my rights to the present invention be limited only by the scope of the appended claims.

I claim:

1. A directional-antenna-placement visual aid for a directional antenna having a directional-signal pattern and an antenna-mounting surface having a known angular relationship to the directional-signal pattern, comprising:

a positioning bar having an antenna-matching surface adapted to match the antenna-mounting surface;

at least one laser-light projector attached with a rotatable connector to said positioning bar in fixable positions corresponding to the directional-signal pattern;

said laser-light projector projecting at least one line of laser light corresponding to at least one boundary of the directional-signal pattern;

said laser-light projector comprising a laser-light emitter mounted in an inner sleeve, an outer sleeve mountable on said inner sleeve in adjustable positions allowing adjustment of the line of laser light to correspond to the directional signal pattern by blocking adjustable portions of the line of laser light;

where said laser-light projector fixed to said positioning bar in relation to said antenna-matching surface, when matched to the antenna-mounting surface, casts a visual representation of at least one boundary of the directional-signal pattern, allowing immediate visual identification of the directional-signal pattern for alignment and confirmation of the placement of the antenna, and where said outer sleeve and inner sleeve further comprise matching threaded portions for said adjustment of the line of laser light to correspond to the directional signal pattern by blocking adjustable portions of the line of laser light.

2. A method for placing a directional antenna having a directional-signal pattern and an antenna-mounting surface having a known angular relationship to the directional-signal pattern, comprising:

(i) providing a directional-antenna-placement visual aid, comprising:

(a) a positioning bar having an antenna-matching surface adapted to match the antenna-mounting surface; and (b) at least one laser-light projector attached with a rotatable connector to said positioning bar in fixable positions corresponding to the directional-signal pattern;

said laser-light projector comprising a laser-light emitter mounted in an inner sleeve, an outer sleeve mountable on said inner sleeve in adjustable positions allowing adjustment of the line of laser light to correspond to the directional signal pattern by blocking adjustable portions of the line of laser light;

where said laser-light projector fixed to said positioning bar in relation to said antenna-matching surface, when matched to the antenna-mounting surface, casts a visual representation of at least one boundary of the directional-signal pattern, allowing immediate visual identification of the directional-signal pattern for alignment and confirmation of the placement of the antenna;

(ii) placing and adjusting the directional antenna; and (iii) using said directional-antenna-placement visual aid;

where said placement and adjustment of the directional antenna is performed with the aim of avoiding or minimizing any overlapping of the directional-signal pattern of the directional antenna with any directional-signal pattern of any other directional antenna using the same radio frequency or frequencies.

3. The method for placing a directional antenna of claim 2, further comprising placing more than one directional antenna in a large venue.

4. The method for placing a directional antenna of claim 2, further comprising advance analysis and planning for use of directional antennae having desired directional-signal patterns and of location placement and angular placement of each such directional antenna in a large venue, with the aim of achieving adequate RF signal coverage while avoiding or minimizing overlapping coverage.

5. The method for placing a directional antenna of claim 2, further comprising placement of the directional antenna at a horizontal angle to rows of seating in a large venue such that a boundary of the directional-signal pattern falls in a line approximately perpendicular or approximately parallel to the rows of seating, and placing an adjacent directional antenna at a corresponding angle, such that the adjacent boundaries of the directional-signal patterns are approximately co-linear with minimal overlapping.

6. The method for placing a directional antenna of claim 2, further comprising adjacent placement of directional antenna having different directional-signal patterns such that the adjacent boundaries of the directional-signal patterns are approximately co-linear with minimal overlapping.

7. The method for placing a directional antenna of claim 2, further comprising placement of a directional antenna at a sharp downward vertical angle in a large venue such that the directional-signal pattern does not reach the opposite side of the large venue.

8. The method for placing a directional antenna of claim 2, further comprising placement of a directional antenna at a location on one side of a large venue, angled such that the directional-signal pattern only reaches the middle and opposite side of the large venue, without reaching the one side where the directional antenna is located.

9. The method for placing a directional antenna of claim 2, further comprising placement of a directional antenna in the middle of a large venue such that the directional-signal pattern only reaches one side of the large venue without reaching any directly or obliquely opposite side of the large venue.

* * * * *